United States Patent [19]

D'Ambra

[11] 4,122,764

[45] Oct. 31, 1978

[54] PORTABLE FOOD WARMER

[76] Inventor: Grace D'Ambra, 149-45 Northern Blvd., Flushing, N.Y. 11354

[21] Appl. No.: 827,364

[22] Filed: Aug. 24, 1977

[51] Int. Cl.[2] ..... F24C 5/20

[52] U.S. Cl. ..... 99/483; 126/38; 126/265

[58] Field of Search ..... 99/339, 483; 126/38, 126/246, 261, 265, 266; 206/544; 220/17, 307; 248/27.3, 311.1, 313; 431/255, 258, 344

[56] References Cited

U.S. PATENT DOCUMENTS

| | | | |
|---|---|---|---|
| 2,129,239 | 9/1938 | Rook | 431/196 |
| 2,572,826 | 10/1951 | Shaw | 99/339 |
| 2,659,295 | 11/1953 | Soccoli | 99/483 |
| 3,080,861 | 3/1963 | Amero | 126/38 |
| 3,189,016 | 6/1965 | Corlet | 126/38 |
| 3,292,668 | 12/1966 | Little | 126/38 |
| 3,398,732 | 8/1968 | Barker | 126/38 |
| 3,608,538 | 9/1971 | Guerrero | 126/38 |

*Primary Examiner*—Robert W. Jenkins
*Assistant Examiner*—John M. Jillions
*Attorney, Agent, or Firm*—Leonard W. Suroff

[57] ABSTRACT

A portable apparatus is disclosed for warming food products which is powered by fuel, such as liquefied petroleum gas, from a fuel container having a valve at one end thereof and an annular rim at substantially the other end thereof, which fuel is to be initially ignited by a battery power source. The portable food warmer includes housing means having a chamber therein with a hot plate mounted across the housing means with the chamber closed by the hot plate and heater means mounted in the chamber for warming the hot plate. The heater means includes a burner extending in vertically spaced relationship below the hot plate for heating same, and regulator means operatively connected to the burner to control the volume of fuel flowing to the burner from the container, with coupling means for releasably connecting the regulator means to the valve of the container for operatively opening the valve to permit a flow of fuel to the regulator means. Ignition means in the chamber is mounted in operable relation to the burner and adapted to be coupled to the battery so as to ignite the fuel upon the commencement of usage of the portable apparatus when fuel is flowing through the regulator means. Mounting means is operatively associated with the housing means so as to removably support the container in operative relation to the coupling means so as to open the valve and permit a flow of fuel from the container to exit into the coupling means for use in the heater means for maintaining a flame in the burner for a period of time required to warm the food to a desired temperature.

9 Claims, 7 Drawing Figures

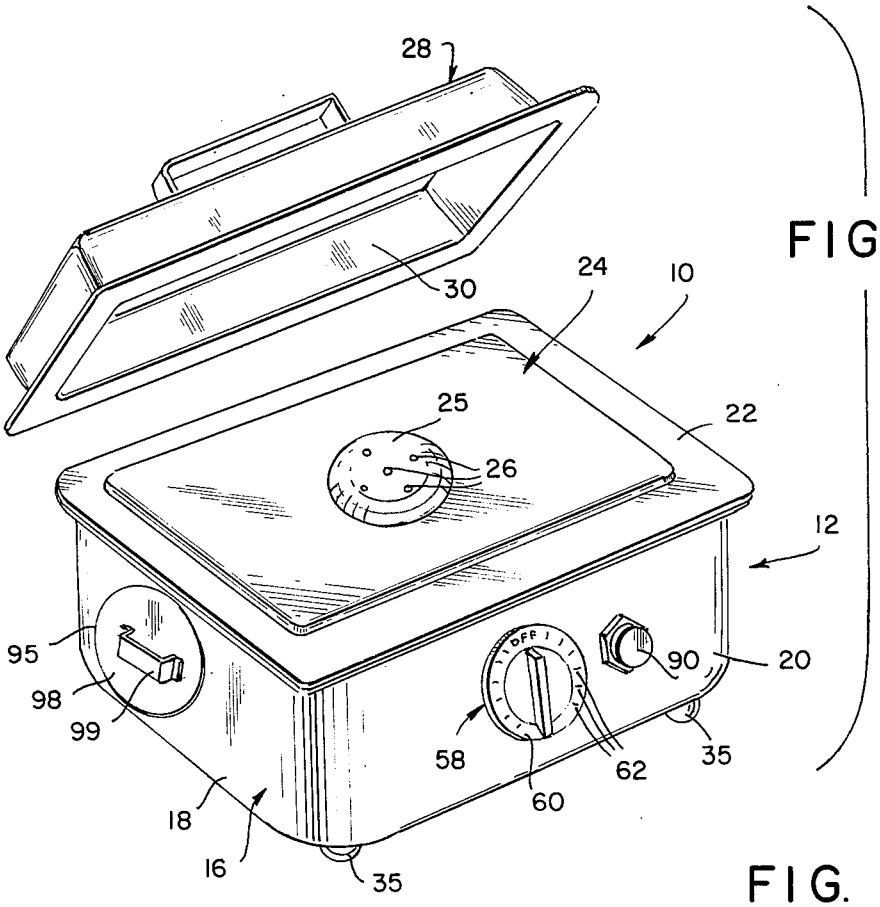
FIG. 1
FIG. 2
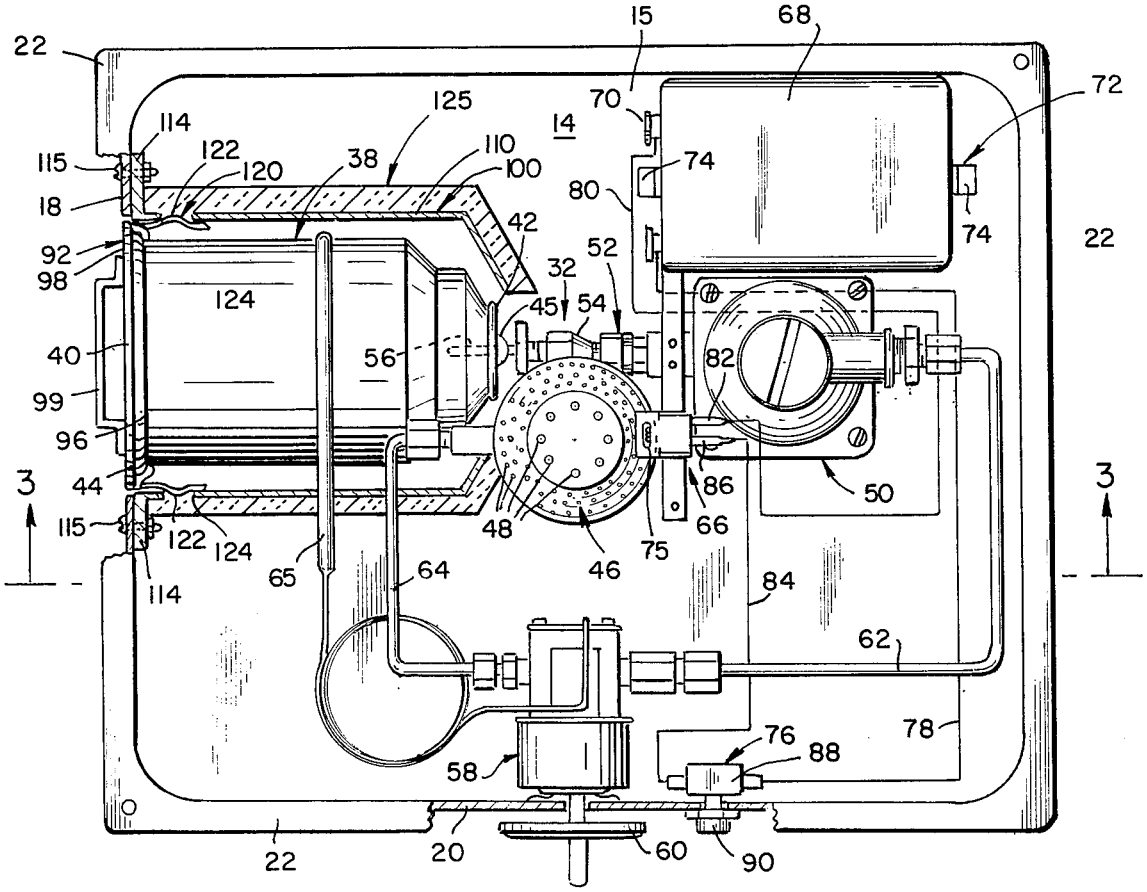

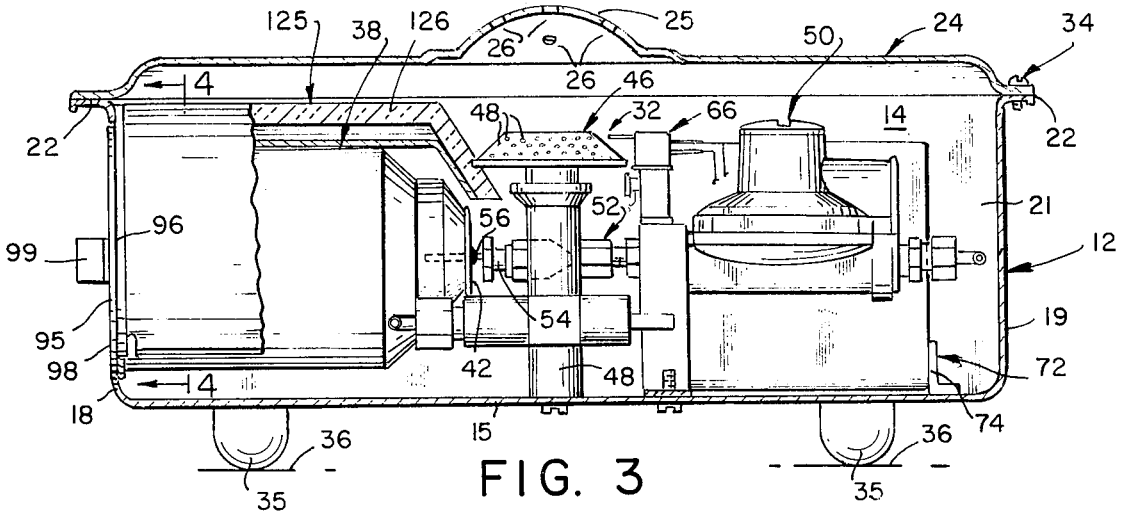
FIG. 3
FIG. 4
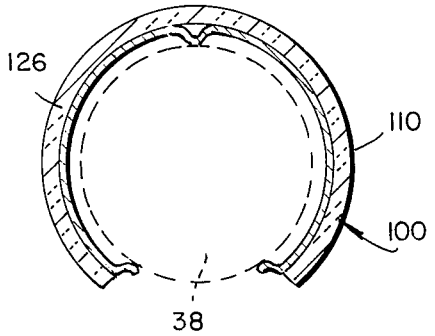
FIG. 5
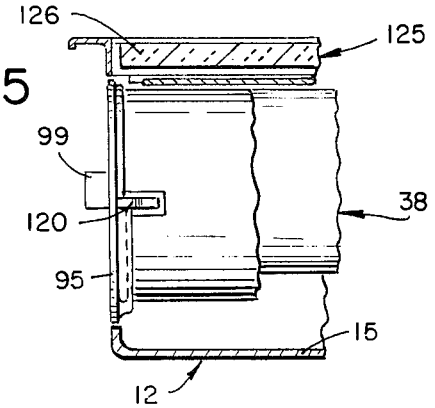
FIG. 6
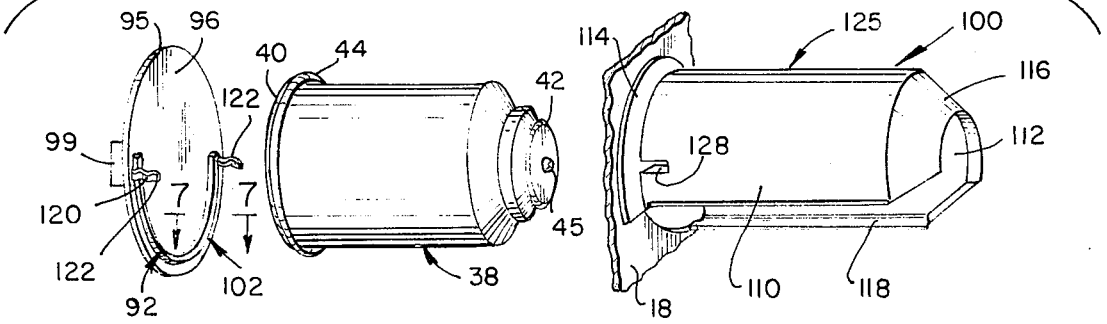
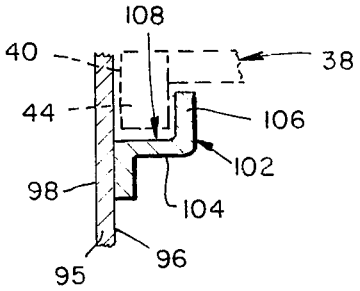
FIG. 7

PORTABLE FOOD WARMER

BACKGROUND OF THE INVENTION

The present invention relates to a portable apparatus for warming food products that may be used indoors or outdoors.

In many instances there is a desire to warm food to an elevated temperature prior to serving same. The present invention provides for a portable apparatus that contains its own supply of fuel and means for initially igniting the fuel as by battery power. In this manner the user of the apparatus is not dependent upon a source of fuel from a pipeline nor do matches have to be utilized. Therefore the portable food warmer of the present invention is totally mobile and may be used both indoors and outdoors. Particularly when on a picnic or vacationing, it is ideal to have a food warmer that is readily turned on for usage at selected temperature levels.

OBJECTS OF THE INVENTION

An object of the present invention is to provide a portable food warming apparatus that contains a preselected quantity of fuel therein in a container which is readily replaceable.

Another object of the present invention is to provide a lightweight portable food heating apparatus that may be utilized both indoors and outdoors.

Other objects and advantages of the present invention will become apparent as the disclosure proceeds.

SUMMARY OF THE INVENTION

A portable apparatus is disclosed for warming food products which is powered by fuel, such as liquefied petroleum gas, from a fuel container having a valve at one end thereof and an annular rim at substantially the other end thereof, which fuel is to be initially ignited from a battery power source. The portable food warmer includes housing means having a chamber therein with a hot plate mounted across the housing means with the chamber closed by the hot plate and heater means mounted in the chamber for warming the hot plate.

The heater means includes a burner extending in vertically spaced relationship below the hot plate for heating same, and regulator means operatively connected to the burner to control the volume of fuel flowing to the burner from the container, with coupling means for releasably connecting the regulator means to the valve of the container for operatively opening the valve to permit a flow of fuel to the regulator means.

Ignition means in the chamber is mounted in operable relation to the burner and adapted to be coupled to the battery so as to ignite the fuel upon the commencement of usage of the portable apparatus when fuel is flowing through the regulator means. Mounting means is operatively associated with the housing means so as to removably support the container in operative relation to the coupling means so as to open the valve and permit a flow of fuel from the container to exit into the coupling means for use in the heater means for maintaining a flame in the burner for a period of time required to warm the food to a desired temperature.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a perspective view of the food warmer apparatus in accordance with the present invention;

FIG. 2 is a top plan view with the top plate removed and partially in section of the food warming apparatus of the present invention;

FIG. 3 is a sectional view taken along line 3—3 of FIG. 2;

FIG. 4 is a sectional view taken along line 4—4 of FIG. 3;

FIG. 5 is a fragmentary view illustrating one aspect of the mounting arrangement of the container;

FIG. 6 is an exploded perspective view illustrating the interrelated relationship of certain means for mounting the disposable container; and FIG. 7 is a fragmentary sectional view taken along line 7—7 of FIG. 6.

DESCRIPTION OF THE PREFERRED EMBODIMENT

Referring to the drawings, there is illustrated in FIGS. 1 through 7 a preferred embodiment of a portable apparatus 10 that is ideally suited for warming food products to desired elevated temperatures. The portability of the apparatus 10 is such that a power outlet is not required in that electrical energy to initially ignite the fuel contained within the apparatus is provided. The apparatus 10 includes housing means 12 having a chamber 14 disposed therein. The housing means 12 may include a bottom wall 15 as well as four upstanding housing walls 16 that extend upwardly from the bottom wall 15 for forming the chamber 14.

The housing wall 16 may include a pair of side walls 18 and 19 and a pair of oppositely disposed end walls 20 and 21. End wall 20 may in effect be the front wall of the housing means 12. The walls 18 through 21 terminate at one end thereof in an upper rim 22 that may extend circumferentially of the housing means 12. A hot plae 24 is provided to extend across the housing means 12 with the chamber 14 being closed by the hot plate 24. The hot plate 24 may have surface configurations thereto, as illustrated in FIG. 3. A dome portion 25 may be centrally disposed thereon and includes a series of openings 26 such that the food products may be disposed in the vicinity of the openings 26.

The apparatus 10 may further include a cover 28 that is adapted to be positioned in overlapping relationship to the hot plate 24 and also include a cavity 30 so as to receive therein food that may be contained on the hot plate 24. The housing means 12, the hot plate 24 and the cover 28 may be fabricated from metallic material to properly transmit heat from within the chamber 14 that is generated by the heater means 32 contained therein and as illustrated in FIGS. 2 and 3. The hot plate 24 may be removably mounted to the housing means 12 as by securing means 34, as illustrated in FIG. 3, so as to provide access to the chamber 14 when so desired. The securing means 34 may include a screw fastener extending through the hot plate 24 into a threaded aperture in the rim 22.

The housing means 12 may further include a plurality of legs 35 that extend downwardly from the bottom wall 15 in order to retain the portable apparatus on a support surface 36. The legs 35 may be made from rubber or other insulative material to avoid transmission of heat to the surface 36. To power the apparatus 10, there is utilized a fuel container 38 that is commercially available and may include a fuel such as liquefied petroleum gas. A manufacturer of such a fuel container 38 that is commercially available is Gerry Div. of Outdoor Sports Ind., Denver, Colo.

The fuel container 38 may be cylindrical in configuration and include a pair of oppositely disposed ends 40 and 42. At end 40 there is provided an annular rim or bead 44, and at the other end 42 there is provided a valve 45 which has an axially extending aperture therein.

The container 38 is so designed that the valve 45 is opened when a needle enters the hole which is provided in the valve which includes a rubber grommet. Upon opening of the valve, the fuel contained therein is available to be utilized. The container 38 may come in various sizes and therefore after use for a period of time is disposed and a new fuel container 38 is replaced in the assembly 10.

The heater means 32 mounted within chamber 14 may include a burner 46 of a type well known in the art that may be mounted by support 48 to extend upwardly from the bottom wall 15. The burner 46 includes a plurality of jet openings 48 from which the flame emanates. Mounted in operative relationship to the burner 46 is regulator means 50 that may be of a conventional type well known in the art and through which the fuel from the container 38 will flow. There is also provided coupling means 52 for releasably connecting the regulator means 50 to the valve 45 of the container 38 for operatively opening the valve 45 to permit a flow of fuel to the regulator means 50.

The coupling means 52 may include a conduit 54 having a needle-like connecting element 56 at one end which is adapted to extend within the valve 45 to open same in order to permit a release of the liquefied gas fuel contained therein. Once the gas fuel is released, it is free to flow into the regulator means 50. In order to selectively vary the flow of fuel, the regulator means 50 may further include a control switch 58, that may also be in the form of a thermostat which has a dial 60 mounted thereon with indicia 62 in the form of temperature.

The control switch 58 may be mounted with respect to the front wall 20 such that the knob or dial 60 extends beyond the housing wall 20 so as to permit the user of the portable apparatus 10 to manually adjust same between an open and closed position. In the open position fuel may flow through the regulator means 50, conduit 62, into the control switch 58 and thereafter through conduit 64 into the burner 46. An expansion coil system 65 is provided in conjunction with the control switch 58 in a manner well known in the art. The control switch 58 by adjustment of the dial or knob 60 regulates the flow of fuel and in turn acts as a thermostat which is contained on the indicia 62.

The apparatus 10 further includes ignition means 66 mounted in the chamber 14 and adapted to be coupled to a battery 68 having a pair of spaced apart terminals 70. The ignition means 66 is mounted in operable relation to the burner 46 in order to ignite the fuel upon the commencement of usage of the portable apparatus 10 when fuel is flowing through the regulator means 50. In order to retain the battery 68 in fixed position, there may be provided retaining means 72 that may be in the form of a pair of brackets 74 mounted on opposite sides of the battery 68. In this manner the battery 68 remains in place during transportation of the apparatus 10 and may be removed when replacement thereof is required.

The ignition means 66 may include a filament 75 adapted to receive an electric current to elevate the filament 75 to a temperature of sufficient elevation to ignite the fuel. To permit manual operation there is provided switching means 76 that may be mounted on front wall 20 and which is electrically connected by lead 78 to one terminal 70 of the battery 68. Lead 80 connects the opposite terminal 70 to terminal 82 of the ignition means 66. Lead 84 connects the opposite terminal 86 to the other end of switching means 76. In this manner an electric circuit is obtained such that when the switching means is in its energized position, electric current flows through the filament 75 to heat same. The switching means 76 may include a switch 88 having a depressable switching element 90 which extends beyond the front wall 20. By depressing the switching element 90, and concurrently with a flow of gas into the burner 46, ignition of the gas will take place.

Accordingly, in operation the user will initially rotate dial 60 to an on position such that the control switch 58, and the valve contained therein, is opened to permit an escape or flow of gas from the container 38 to burner 46. As this is occurring the depressing of the switching element 90 provides a current to heat the filament 75 until the gas lights and the switching element is released. It is then possible to adjust dial 60 to a desired elevated temperature, as indicated by indicia 62. When the assembly 10 is no longer utilized, dial 60 may be turned to its off position and further flow of gas will be prevented.

In view of the fact that the container or cartridge 38 is of limited supply, it must be replaced from time to time, and to accomplish this there has been provided mounting means 92 associated with one of the walls of the housing means 12. As illustrated, side wall 18 has an opening 94 extending therethrough in order to permit the container to enter therethrough. The mounting means 92 is designed such that upon insertion of the fuel container 38, the valve 45 is automatically guided into seated position with the connecting element 56. To accomplish this task, the mounting means 92 in the preferred embodiment illustrated includes a closure or end plate 95 having an oppositely disposed inner end 96 and outer end 98. A handle 99 may be mounted on the outer end 98 of the closure 95 such that insertion and removal of the container 38 within guide means 100 is facilitated.

As illustrated in FIGS. 6 and 7, support means 102 forms part of the mounting means and is associated with the inner end 96 of closure 95 to provide releasable engagement between the annular rim 44 of the container 38 and the closure 95. The support means 102 includes an arm 104 extending outwardly from the inner end 96 and a finger 106 disposed in vertically spaced relationship to the inner end 96 of the closure 95 and connected to the arm 104 at one end thereof. The finger 106 being spaced from the inner end 96 of closure 95 a distance so as to provide a seat 108 for receiving the rim 44 of the container 38 therein such that a releasable assembly therebetween is obtained. The seat 108 may be dimensioned to obtain frictional engagement between the rim 44 and finger 106.

In order to obtain ready insertion and removal of the container 38 in mounted relationship with the closure 95, the finger 106 may subtend an arc of approximately 180°, as illustrated in FIG. 6. The guide means 100 extends within the chamber 14 and adjacent wall 18 so as to guide the container 38 longitudinally into the position in which the connecting element 56 penetrates the valve 45.

The guide means 100 may include a guide member 110, as illustrated in FIG. 6, that has an axially extending bore 112 therethrough. The guide member 110 includes a radial flange 114 adapted to be mounted as by fasteners 115 to the wall 18 of housing means 12. The radial flange 114 is contained at one end of the guide member 110 and an inwardly tapered skirt 116 extends from the other end of the guide member 110 in conformable relation to the end of the container 38 having the valve 45 thereon. The guide member 110 may have a longitudinally extending slot 118 the length thereof. The guide member 110 is so mounted that the container 38 is adapted to be positioned in telescopic relationship with bore 112 and in alignment with connecting element 56.

Accordingly, once the closure 95 is assembled with the container 38 utilizing the support means 102, the container 38 is adapted to be inserted within the guide means 100. Once this insertion has been made, there has been provided latch means 120 that is associated with the closure 95 for releasably connecting the closure 95 to the housing means 12. The closure 95 may have a greater dimension than, or fit within, the opening 94 on wall 18.

The latch means 120 may include at least one pair of spring-like latch members 122 that extend outwardly from the inner end 96 of closure 95 and adjacent to the arm 104. There is provided a pair of openings 124 that is associated with each of the latch members 122 so as to provide a nest for receiving the latch members 122 therein. The dimensional relationship is such that the latch members 122 are received in the openings 124 when the valve 45 is in operative relationship with the coupling means 52.

In view of the fact that the contents of the container 38 is highly flammable, there has been provided insulation means 125 in surrounding relationship to the guide member 110 to prevent excess heat from reaching the contents of the container 38. The insulation means 125 may include a sleeve 126 of insulative material designed to prevent heat buildup of the wall of the container 38. The insulation sleeve 126 may have slits 128 in those areas where the latch members 122 are positioned.

Accordingly, in accordance with the preferred embodiment the container 38 is readily assembled with the support means 102 and the closure 95 is inserted utilizing the guide means 100 until the connecting element 56 pierces the valve 45. The dimensional relationship is such that the latch members 122 are contained within the opening 124. When the fuel in the container 38 has been exhausted, then the handle 99 is pulled upon and the container 38 and closure 95 are pulled out from the position illustrated in FIG. 2 and a new container 38 is positioned as previously described.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A portable apparatus for warming food products and powered by fuel from a fuel container having a valve at one end thereof and an annular rim at substantially the other end thereof which fuel is to be initially ignited by a battery power source, said portable food warmer comprising in combination:

A. housing means having a chamber therein,

B. said housing means including a bottom wall with housing walls extending upwardly from said bottom wall and forming said chamber, C. a hot plate mounted across said housing means with said chamber closed by said hot plate, D. means for retaining said battery in removable position in said housing means, E. heater means mounted in said chamber, said heater means comprising:

(1) a burner extending in vertically spaced relationship below said hot plate for heating same, (2) regulator means operatively connected to said burner to control the volume of fuel flowing to said burner from said container, and (3) coupling means for releasably connecting said regulator means to said valve of said container for operatively opening said valve to permit a flow of fuel to said regulator means, F. ignition means in said chamber mounted in operable relation to said burner and adapted to be coupled to said battery so as to ignite the fuel upon the commencement of usage of the portable apparatus when fuel is flowing through said regulator means, said ignition means including (4) a filament adapted to receive an electric current to elevate same to a temperature sufficient to ignite the fuel, and (5) switching means coupled to said battery and said filament such that when said switching means is in its energized position electric current flows through said filament to heat same, G. mounting means operatively associated with one of said walls of said housing means and in alignment with said coupling means so as to removably support said container in operative relation to said coupling means so as to bring said valve into abutting engagement with said coupling means to open said valve and permit a flow of fuel from said container to exit into said coupling means for use in said heater means for maintaining a flame in said burner, H. said mounting means comprises:

(6) a closure having oppositely disposed inner and outer ends, (7) support means mounted on said inner end to provide releasable engagement between said annular rim of said container and said closure such that said container may be moved into position so as to engage said coupling means, (8) guide means extending within said chamber adjacent one said wall of said housing means to guide said container longitudinally into said position in which said coupling means engages said valve for opening same thereto, (9) a handle mounted on said outer end of said closure such that insertion and removal of said container in said guide means is facilitated,

(10) said guide means includes:

(a) a guide member having an axially extending bore therethrough, (b) said guide member being mounted on one of said walls such that said container is adapted to be positioned in telescopic relationship with said guide member, and (c) said guide member includes a radial flange on one end thereof for coupling to one of said walls, and said other end includes an inwardly tapered skirt for extending in conformable relation to the end of said container having said valve thereon, and

(11) said support means includes:

(a) an arm extending outwardly from said inner end of said closure, (b) a finger disposed in vertically spaced relationship to said inner end of said closure and connected to said arm at one end thereof, and (c) said finger being spaced from said inner end of said closure a distance so as to provide a seat for receiving said rim of said container therein such that a releasable assembly therebetween is obtained, I. latch means for coupling said closure in releasably fixed position relative to one of said walls of said housing means, and J. said latch means includes:

(1) at least a pair of flexible latch members extending outwardly from said inner end of said closure, (2) openings disposed on said guide means to provide a nest for receiving said latch members therein, and (3) said latch members being received in said openings when said valve is in operative relationship with said coupling means.

2. The apparatus as defined in claim 1, including a. insulation means in surrounding relationship to said mounting means so as to prevent excess heat from reaching the contents of said container, b. a cover for enclosing said hot plate, and c. said insulation means includes a sleeve of insulative material extending in telescopic relationship to said guide means.

3. The apparatus as defined in claim 1, wherein said housing walls include a pair of side walls and a pair of oppositely disposed end walls extending intermediate said side walls, said housing walls terminating in an upper rim across which said hot plate is mounted.

4. The apparatus as defined in claim 3, including securing means for releasably connecting said hot plate to said rim.

5. The apparatus as defined in claim 1, wherein said regulator means includes a control switch mounted to partially extend beyond one of said housing walls so as to permit the user of the portable apparatus to manually adjust same between an open and closed position, such that in said open position fuel from said container flows through said regulator means and is ignitable by said ignition means.

6. The apparatus as defined in claim 1, wherein said hot plate includes a series of openings therethrough and on which said food products may be disposed in the vicinity of said openings.

7. The apparatus as defined in claim 1, wherein said seat is dimensioned to obtain frictional engagement between said rim and said finger.

8. The apparatus as defined in claim 7, wherein said arm and said finger subtend an arc of approximately 180° to partially enclose said rim.

9. The apparatus as defined in claim 1, wherein a. said switching means includes a switch having a depressable switching element mounted on one of said walls and said switching means is brought into its energized position by depressing said switching element such that to ignite said burner said switching element is maintained in its depressed position for a momentary period of time required to ignite said burner, and b. said regulator means includes a control switch mounted to partially extend beyond one of said housing walls so as to permit the user of the portable apparatus to manually adjust same between an open and closed position, such that in said open position fuel from said container flows through said regulator means and is ignitable by said ignition means and thereafter continues to burn.

* * * * *